United States Patent [19]

Popp et al.

[11] Patent Number: 4,783,309

[45] Date of Patent: Nov. 8, 1988

[54] DOUBLE CONTAINER SYSTEM FOR TRANSPORTING AND STORING RADIOACTIVE MATERIALS

[75] Inventors: Franz-Wolfgang Popp, Wedemark; Bernd Pontani, Alzenau; Erich Ernst, Oftersheim, all of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 61,688

[22] Filed: Jun. 12, 1987

[30] Foreign Application Priority Data

Jun. 20, 1986 [DE] Fed. Rep. of Germany ..... 3620737

[51] Int. Cl.[4] ..... G21F 5/00

[52] U.S. Cl. ..... 376/272; 250/507.1

[58] Field of Search ..... 376/272; 250/506.1, 250/507.1

[56] References Cited

U.S. PATENT DOCUMENTS

| | | | |
|---|---|---|---|
| 3,488,255 | 1/1970 | Hayden et al. | 376/290 |
| 3,780,306 | 12/1973 | Anderson et al. | 250/506.1 |
| 3,930,166 | 12/1975 | Bochard | 250/506.1 |
| 3,935,467 | 1/1976 | Gablin | 250/507.1 |
| 4,339,411 | 7/1982 | Knackstedt et al. | 376/272 |
| 4,453,081 | 6/1984 | Christ et al. | 250/506.1 |
| 4,680,159 | 7/1987 | Lahr et al. | 376/272 |

FOREIGN PATENT DOCUMENTS

| | | | |
|---|---|---|---|
| 2831646 | 1/1980 | Fed. Rep. of Germany | 376/272 |
| 0208500 | 5/1984 | German Democratic Rep. | 376/272 |

*Primary Examiner*—Charles T. Jordan
*Assistant Examiner*—Daniel Wasil
*Attorney, Agent, or Firm*—Walter Ottesen

[57] ABSTRACT

A double container system for transporting and storing radioactive waste materials includes an inner storage container of steel for enclosing the radioactive material to be stored in a gas-tight manner and an outer shielding container which provides for the necessary shielding effect and mechanical security with regard to handling and transportation. A neutron moderator layer is disposed in an annular gap between the outer shielding container and the inner storage container. The neutron moderate layer is made of hydrogen-bearing material, preferably polyethylene. In order to provide a good shielding effect while at the same time providing very good conduction of heat from the inside to the outside, the moderator layer includes individual rings of polyethylene which are stacked one above the other. Arranged between each two mutually adjacent ones of the polyethylene rings is a ring of a heat-conducting metal material having an H-profile when viewed in radial section. The legs of the H-profile ring embrace the sides of the two mutually adjacent polyethylene rings for fixing the latter in position.

10 Claims, 4 Drawing Sheets

DOUBLE CONTAINER SYSTEM FOR TRANSPORTING AND STORING RADIOACTIVE MATERIALS

FIELD OF THE INVENTION

The invention relates to a double container system for transporting and storing radioactive waste material or irradiated nuclear fuels. The double container system includes an inner storage container of steel for enclosing the radioactive material to be stored in a gas-tight manner and an outer shielding container which provides for the necessary shielding effect and mechanical security for handling and transport. The outer shielding container and inner storage container conjointly define an annular gap for accommodating a neutron moderator layer therein.

BACKGROUND OF THE INVENTION

Certain measures have to be taken in order to provide for adequate shielding of gamma and neutron radiation for containers holding radioactive materials. For the purposes of additionally shielding the neutron radiation which comes from the radioactive nuclear fuel, the usual practice is to provide a neutron shielding layer of a hydrogen-bearing material, preferably polyethylene, around the storage container. Because of the poor thermal conductivity of such neutron-shielding materials, it is known to arrange thermally-conductive struts in that layer to connect the surface of the container with the outside atmosphere.

German published patent application DE-OS No. 28 31 646 discloses a shielding container which has a neutron-shielding layer of granular polyethylene and in which the heat-conducting struts are connected to an external surface of a relatively thin-walled steel jacket to provide for better discharge of the decay heat to the ambient. The thin steel jacket serves only to provide for a good discharge of the decay heat to the ambient.

In the case of double container systems in which the containers are disposed one within the other and must fulfill different requirements, the shielding container has a wall thickness which is usually 200 mm in order to provide the necessary shielding against radioactive radiation. In addition, the thick-walled outer shielding container is to provide mechanical protection for the inner container during transport and when subjected to impact loadings. The inner storage container accommodates the radioactive materials in a gas-tight manner. For this purpose, the inner storage container is provided with a double cover system. The outer secondary cover is welded to the body of the container in a gas-tight manner.

SUMMARY OF THE INVENTION

In view of the above, it is an object of the invention to provide a double container system which includes a neutron moderator structure that provides a good shielding over its entire surface and yet makes possible a good conduction of heat.

The double container system of the invention includes an outer shielding container which provides for the necessary shielding effect and mechanical security for handling and transport and an inner container of steel for holding the radioactive material to be stored. According to a feature of the invention, a neutron moderator structure is provided in an annular gap conjointly defined by the two containers and includes a plurality of individual annular members made of polyethylene. The annular polyethylene members are stacked one above the other and an annular intermediate member is disposed between each two mutually adjacent ones of the annular polyethylene members. The annular intermediate member is made of a heat-conducting metal and has an H-profile when viewed in radial section. The legs of each annular intermediate member enclose the sides of the two mutually adjacent polyethylene members.

The neutron moderator structure defines a jacket which is interrupted only by the horizontal webs of the H-profile annular members to provide heat-conductive bridges between the inner and outer containers. The arrangement of the lateral legs which are perpendicular to the horizontal webs fixes the polyethylene members and at the same time ensures good conduction of heat because of their sufficiently large areas which are in metal contact with the inside surface of the shielding container and the outside surface of the inner storage container, respectively. The thickness and the spacing of the horizontal webs can be selected in accordance with the heat to be removed.

The invention makes it possible to provide the neutron moderator structure in a technically simple manner because the polyethylene members can be stacked in superposed relationship in a simple manner and are fixed by the H-section annular members. The superposed stacking array produces a cylindrical composite structure. With the invention, neutron radiation is substantially prevented while at the same time an excellent conduction of heat from the storage container to the ambient is achieved via the annular metal members having an H-shaped profile when viewed in radial section.

According to another feature of the invention, each polyethylene annular member includes at least two segments conjointly defining partition interfaces therebetween which extend at an acute angle ($\alpha$) to a line passing through the longitudinal axis of the double container system. At room temperature the segments conjointly define a gap at each partition interface which is closed at the highest operating temperature which can be expected. This arrangement assures that the individual segments are already in an overlapping relationship at ambient temperature.

Pursuant to another feature of the invention, the annular intermediate member having the H-profile is made of aluminum and is interrupted by a partition interface. The gaps in the H-section annular members provide a ready option in regard to installing the annular members. The annular members can be introduced in a prestressed form so that the outer legs of these members are caused to bear closely against the inside surface of the shielding container.

In another advantageous embodiment of the invention, the polyethylene rings comprise ultra-high molecular low-pressure polyethylene. It has surprisingly been found that ultra-high molecular low-pressure polyethylene is particularly suitable for the shielding of a double container structure. This is attributed to the fact that the low-pressure polyethylene does not have any plasticizers and solvents and therefore only suffers from a minimal amount of outgassing. Moreover, no melting of the low-pressure polyethylene occurs at the temperature ranges used. In addition, the low-pressure polyethylene remains in a rubber-elastic condition up to 250° Celsius.

In a further advantageous embodiment of the invention, the neutron moderator structure is spring-loaded at its top side. This spring loading which acts in the longitudinal direction makes it possible to compensate for the length of the moderator structure because of the generation of heat.

The ends of the storage container are received in respective inner guides of the shielding container. The inner diameters of these ends correspond approximately to the inner diameter of the moderator structure which extends over the length between the inner guides. This feature provides that the neutron moderator structure is not subjected to impact or shock loadings. Shock loadings are carried away from the inner storage container by means of the guides to the shielding container.

BRIEF DESCRIPTION OF THE DRAWING

The invention will now be described with reference to the drawing wherein.

DESCRIPTION OF THE PREFERRED EMBODIMENTS OF THE INVENTION

Figure 1:
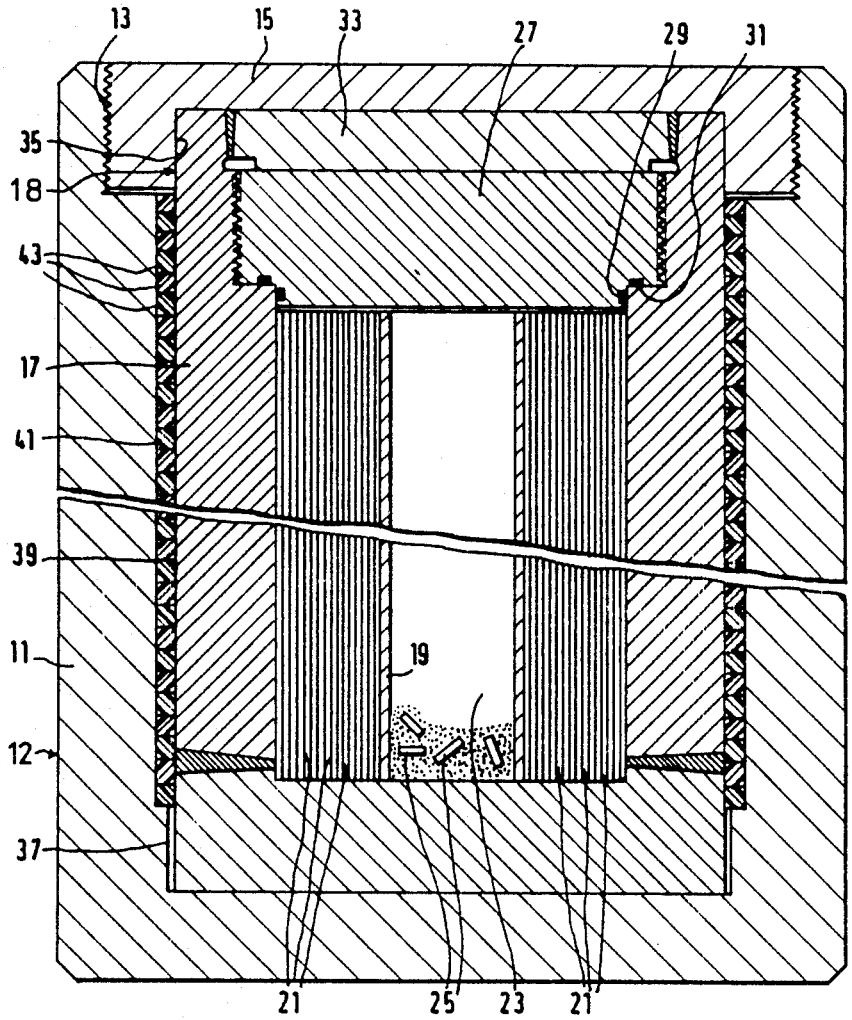
FIG. 1 shows a double container system according to the invention which includes an outer container and an inner container and a moderator layer between the two containers.

The double container system illustrated includes a shielding container 12 for shielding against gamma and neutron radiation and is made of cast iron with nodular graphite (GGG-40). The grade GGG-40 is listed in German nodular cast iron specifications. The container 12 has a vessel 11 defining a loading opening 13 and has a shielding cover which threadably engages the vessel 11 to close the opening.

A storage container 18 of steel is seated in a circular cavity in the shielding container 11. In its cavity, the storage container 18 has an insertable grid 19 for accommodating individual, closely arranged fuel rods 21 of a disassembled nuclear reactor fuel element. The scrap portions 25 of the disassembled nuclear reactor fuel elements are disposed in the free central space 23 of the insertable grid 19 together with a charge of bonding material such as synthetic resin.

The container 18 includes a vessel 17 and two covers 27 and 33. The storage space of the storage container 18 is closed by the primary cover 27 which threadably engages the vessel 17 with the inclusion of sealing rings 29 and 31. The secondary cover 33 terminates flush with the upper outside edge of the vessel 17 and is seated over the primary cover 27 in the loading opening of the storage container 18, and is welded to the vessel 17 of the container 18.

The shielding cover 15 of the shielding container 12 has an inner cylindrical recess 35 into which the upper end of the storage container 18 matchingly extends. The lower part of the storage container 18 is guided by an inner step 37 of the shielding container 12. The inside diameter of the shielding container 12 increases above the inner step 37 and thus provides an annular gap 39 in which a neutron moderator structure 41 is mounted. The neutron moderator structure 41 reduces the kinetic energy of neutrons and includes a plurality of individual superposed polyethylene rings or annular members 43. The polyethylene rings 43 can be made, for example, of ultrahigh low-pressure polyethylene.

Figure 2:
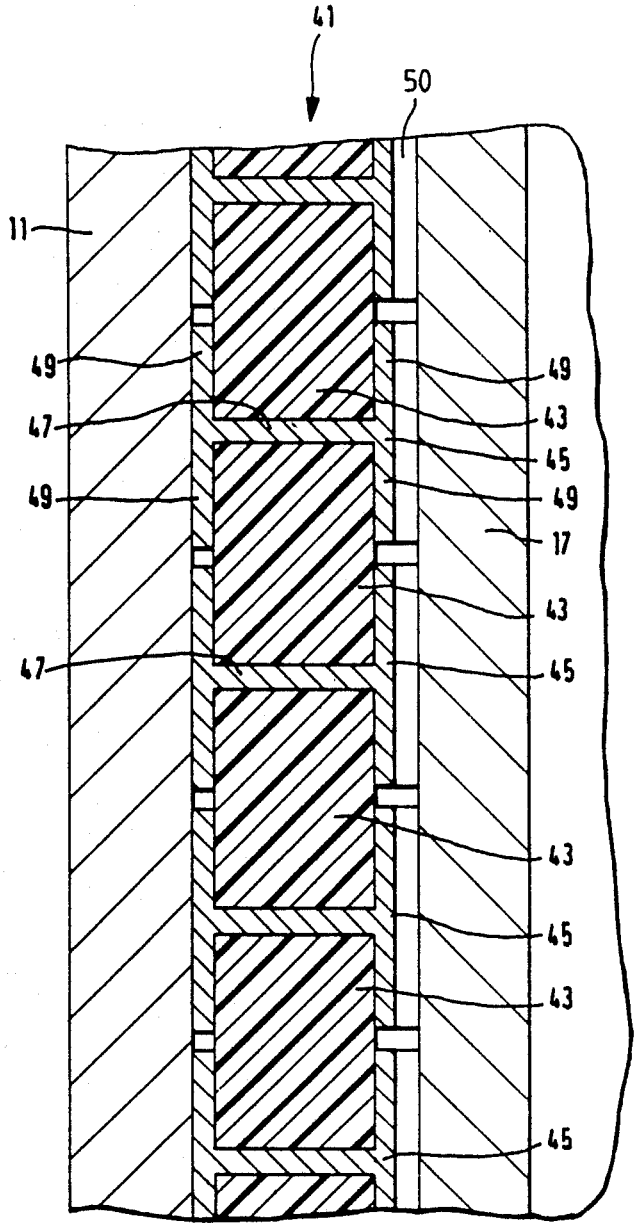
FIG. 2 is a view on an enlarged scale of a portion of the structure of the moderator.

For the purposes of fixing the polyethylene annular members 43, an aluminum ring or annular member 45 of H-section (FIG. 2) is arranged between each two mutually adjacent polyethylene rings 43. The stacked arrangement of the rings produces a cylindrical configuration for the moderator structure 41. The horizontal web 47 of each individual H-section ring 45 interrupts the neutron moderator layer 41 only over a small area. The vertical legs 49 are disposed adjacent to the inside surface of the shielding container 12 and the outer surface of the storage container 18, respectively.

Prior to introduction of the loaded storage container 18 and prior to an increase in temperature due to the decay heat of the radioactive materials, there is an air gap 50 between the inner side surface of the neutron moderator 41 and the outer surface of the storage container 18. The gap 50 provides a clearance space which permits the storage container 18 to be lowered into the shielding container 12. This gap 50 is closed upon an increase in temperature and expansion of the container 18 and the aluminum rings 45.

Figure 3:
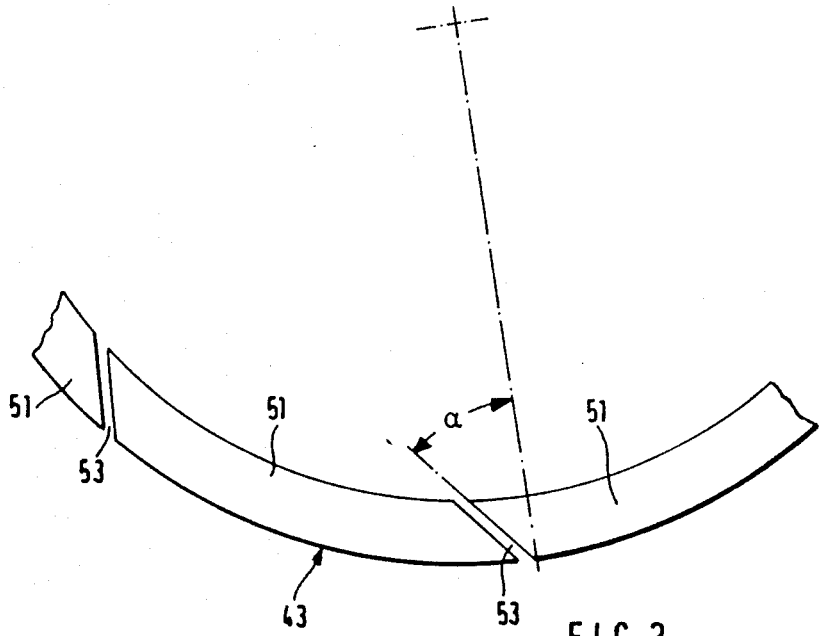
FIG. 3 is a plan view of a polyethylene annular member which is subdivided into arcuate segments.
Figure 4:
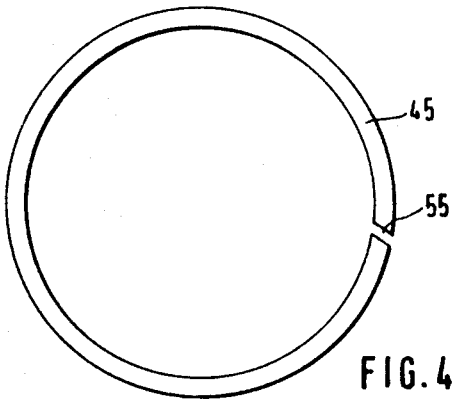
FIG. 4 shows a plan view of an aluminum intermediate annular member having an H-shaped profile when viewed in radial section.

The polyethylene rings 43 each include individual arcuate segments 51 which are fitted together to provide a ring configuration and the partition interfaces 53 of which are disposed at an acute angle $\alpha$ relative to the center line (FIG. 3) passing through the longitudinal axis of the double container system.

The H-section rings 45 of aluminum are each interrupted by a partition interface 55 so that it is possible for the H-section rings 45 to be fitted into the double container system in a prestressed condition. This causes the outer legs 49 of the H-section rings 45 to bear snugly against the inner surface of the shielding container 12.

The assembly of the double container system will be described below.

The neutron moderator structure 41 is introduced into the open shielding container 12 by introducing the individual layers of polyethylene rings 43 and interposed H-section rings 45. In this way, the cylindrical moderator structure 41 extends in its length into the cover region and into the bottom region of the storage container 18 which is thereafter introduced into the container 12. This arrangement of the moderator structure 41 therefore provides an adequate shielding effect over the height of the storage container 18. The storage container 18 is loaded with the radioactive materials in a hot cell. The primary cover 27 is seated and screwed into position on the projecting wall portion of the vessel 17. The secondary cover 33 can then be welded into position. The storage container 18 is then introduced into the shielding container 12.

The shielding cover 15 is screwed into the opening of the shielding container 12 and the storage container 18 is now fixed. Any shock loadings which occur during transport of the system are taken up by the guide 35 in the shielding cover 15 and the guide 37 in the bottom region of the shielding container. The neutron moderator 41 is protected from shock loadings.

The gaps defined at the partition interfaces 53 of the polyethylene rings 43 are arranged by virtue of their inclined position at the angle α in such a way that the individual segments 51 are already in a covered-over or overlapping relationship at ambient temperature. The gaps shown at the partition interface 53 are closed at the highest operating temperature to be expected.

Figure 5:
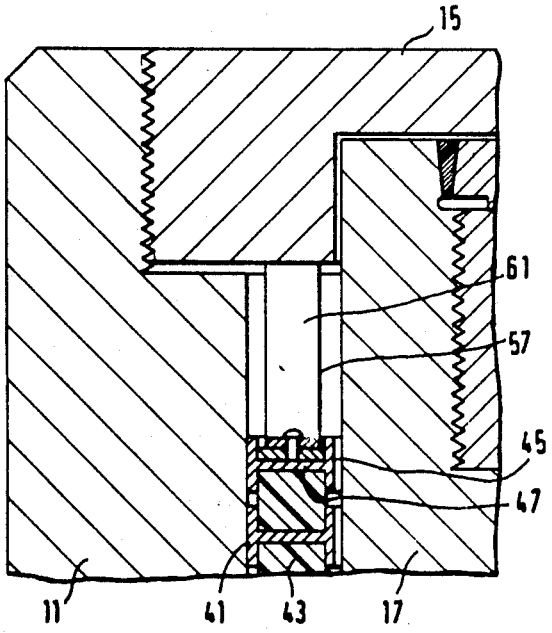
FIG. 5 shows a compression spring arrangement for resiliently loading the moderator structure; and, FIG. 6 shows a plan view of part of the configuration shown in FIG. 5.
Figure 6:
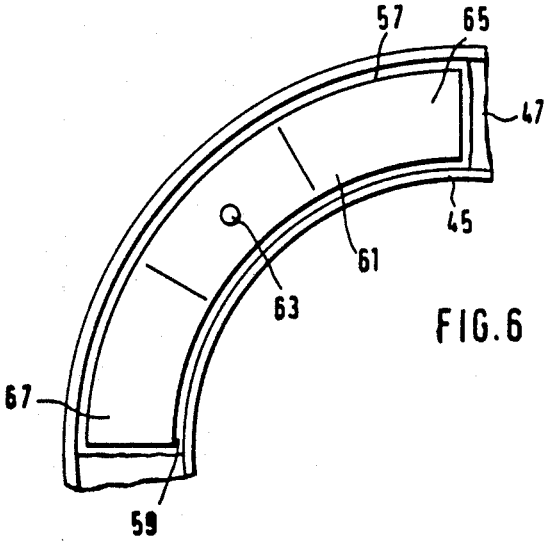

FIGS. 5 and 6 show a compression spring arrangement 57 which is braced between the upper surface of the moderator structure 41 and the shielding cover 15 of the shielding container 12. A flat ring 59 is disposed on the horizontal web 47 of the topmost H-section aluminum ring 45. Twelve leaf spring segments 61 are fixed on the ring 59 by rivet 63. Each leaf spring segment 61 has two upwardly bent legs 65 and 67, the free ends of which bear against the shielding cover 15.

Upon a rise in temperature of the double container system, the moderator structure 41 can expand upwardly in its longitudinal direction. The spring travel serves to provide thermal compensation and serves for already fixing the moderator structure 41 at ambient temperature. The spring force is suitably selected according to the moderator weight.

It is understood that the foregoing description is that of the preferred embodiments of the invention and that various changes and modifications may be made thereto without departing from the spirit and scope of the invention as defined in the appended claims.

What is claimed is:

1. A double container system for transporting and storing radioactive material such as irradiated nuclear fuel, the double container system comprising:

an inner storage container made of steel for holding the radioactive material to be stored;

an outer shielding container defining a cavity for accommodating said storage container therein;

said shielding container having an inner surface and said storage container having an outer surface, said inner surface and said outer surface conjointly defining an annular gap therebetween;

a neutron moderator assembly mounted in said annular gap, said moderator assembly including:

a plurality of individual annular hydrogenous members made of hydrogenous material and stacked in said gap one above the other, each one of said annular hydrogenous members having two lateral sides facing said inner and outer surfaces, respectively;

a plurality of mutually separate heat-conducting annular metal members having respective H-profiles when viewed in radial section;

each of said annular metal members being disposed and stacked between each two mutually adjacent ones of the annular hydrogenous members; and, each of said metal having a horizontal web and four legs extending therefrom to define said H-profile and being placed between said mutually adjacent stacked annular hydrogenous members so as to cause said legs to at least partially enclose said lateral sides of said hydrogenous members.

2. The double container system of claim 1, wherein each of said annular hydrogenous members is made of polyethylene.

3. The double container system of claim 2, said containers conjointly defining a common longitudinal axis; and, each of said polyethylene members comprising at least two segments separated by partition interfaces whereat respective gaps are present at ambient temperature and whereat said gaps are closed when the temperature rises to the highest expected operating temperature produced by the decay heat generated by the radioactive material stored in said storage container; and, said gaps extending at an acute angle (α) to a radial line passing through said axis.

4. The double container system of claim 1, said annular metal members being made of aluminum and being interrupted along their arcuate length to define a partition interface.

5. The double container system of claim 2, said annular hydrogenous members being made of ultrahigh molecular low-pressure polyethylene.

6. The double container system of claim 2, comprising resilient biasing means for resiliently biasing said neutron moderator assembly within said shielding container.

7. The double container system of claim 6, said shielding container having a vessel defining said cavity for accommodating said storage container therein and a cover for closing said vessel; said resilient biasing means including a plurality of leaf-spring segments arranged on top of said moderator assembly and bent upwardly so as to resiliently brace the latter against said cover.

8. The double container system of claim 7, said plurality of leaf-spring segments defining a leaf-spring unit, said resilient biasing means including a plurality of said units disposed on top of said moderator assembly so as to be distributed about the top circular periphery thereof.

9. The double container system of claim 2, said shielding container having a vessel defining said cavity for accommodating said storage container therein and a cover for closing said vessel; said neutron moderator assembly being a cylindrical structure having an inner diameter and disposed in surrounding relationship to said storage container and extending longitudinally from the base of said vessel up to the vicinity of said cover; a first guide in the form of a cylindrical cavity formed in said cover for receiving the upper end of said storage container therein and a second guide also in the form of a cylindrical cavity formed in the base of said vessel for receiving the lower end of said storage container therein, said cylindrical cavities having an inner diameter corresponding approximately to said inner diameter of said cylindrical structure.

10. The double container system of claim 1, the two legs of each of said metal members facing said storage container and said outer surface of said storage container conjointly defining a clearance gap at ambient temperature to permit said storage container to be loaded into said shielding container, the width of said clearance gap being selected so as to cause said outer surface of said storage container to expand and close said gap to come into contact engagement with said last-mentioned two legs when said storage container becomes heated due to the temperature developed by the decay heat generated in said storage container by the radioactive material whereby heat is conducted away from said storage container through said web to said shielding container and the ambient.

* * * * *

UNITED STATES PATENT AND TRADEMARK OFFICE

CERTIFICATE OF CORRECTION

PATENT NO. : 4,783,309

DATED : November 8, 1988

INVENTOR(S) : Franz-Wolfgang Popp, Bernd Pontani and Erich Ernst

It is certified that error appears in the above-identified patent and that said Letters Patent is hereby corrected as shown below:

In the Abstract, line 10: delete "moderate" and substitute -- moderator -- therefor.

In column 5, line 53: between the words "metal" and "having", insert -- members --.

Signed and Sealed this

Twenty-fifth Day of April, 1989

*Attest:*

*Attesting Officer*

DONALD J. QUIGG

*Commissioner of Patents and Trademarks*